US006235393B1

(12) United States Patent
Kimura et al.

(10) Patent No.: US 6,235,393 B1
(45) Date of Patent: May 22, 2001

(54) BIODEGRADABLE COMPLEX FIBER AND METHOD FOR PRODUCING THE SAME

(75) Inventors: Yoshiharu Kimura, Omihachiman; Yoji Hori, Hiratsuka, both of (JP)

(73) Assignee: Takasago International Corporation, Tokyo (JP)

( * ) Notice: Subject to any disclaimer, the term of this patent is extended or adjusted under 35 U.S.C. 154(b) by 0 days.

(21) Appl. No.: 09/526,492

(22) Filed: Mar. 15, 2000

(30) Foreign Application Priority Data

Mar. 15, 1999 (JP) ..... 11-068241

(51) Int. Cl.[7] ..... D01F 8/00
(52) U.S. Cl. ..... 428/373; 428/370
(58) Field of Search ..... 428/370, 373; 264/172.17, 172.15, 292, 291

(56) References Cited

U.S. PATENT DOCUMENTS 5,783,271 * 7/1998 Nishida et al. ..... 428/35.5
5,952,088 * 9/1999 Tsi et al. ..... 428/297.7

FOREIGN PATENT DOCUMENTS 613-780 A2 * 8/1994 (EP) .

OTHER PUBLICATIONS

Patent Abstracts of Japan, JP 09 157954, Publication Date Jun. 17, 1997.
Patent Abstracts of Japan, JP10 102323, Publication Date Apr. 21, 1998.

* cited by examiner

*Primary Examiner*—N. Edwards
(74) *Attorney, Agent, or Firm*—Kubovcik & Kubovcik

(57) ABSTRACT

A biodegradable complex fiber which retains excellent biodegradability and hydrolyzability and has high strength and high melting temperature suitable for practical use and a method for producing the biodegradable complex fiber are provided. The biodegradable complex fiber comprises at least one polymer material selected from the group consisting of a polyglycolic acid, a poly(glycolic acid-co-lactic acid) and polylactic acid as a core component or as a shell component and a polymer material of poly(3-hydroxybutyric acid) groups or a polymer material of an aliphatic polyester consisting of a dibasic acid and a diol as a shell component or as a core component. The method comprises producing the biodegradable complex fiber by melt spinning.

3 Claims, 7 Drawing Sheets

BIODEGRADABLE COMPLEX FIBER AND METHOD FOR PRODUCING THE SAME

BACKGROUND OF THE INVENTION

1. Field of the Invention

The present invention relates to a biodegradable complex fiber and a method for producing the fiber, and more particularly, to a biodegradable complex fiber which can be widely used as fishing materials, e.g., fishing lines and fish nets; agricultural materials, e.g., insect or bird nets and vegetation nets; cloth fibers and non-woven fibers for articles for everyday life, e.g., disposable women's sanitary items, masks, wet tissues, underwear, towels, handkerchiefs, kitchen towels and diapers; and medical supplies, e.g., operating sutures which are not removed, operating nets and suture-reinforcing materials; and which does not pollute the environment. The present invention also relates to a method for producing the biodegradable fiber.

2. Description of Related Art

As polymer materials used for fishing lines, fish nets, agricultural nets, articles for everyday life or the like, those comprising, for example, a polyamide, polyester, polyvinyl chloride or polyolefin have been used. These polymer materials are resistant to degradation and hence have the problem that the environment is polluted when the above products are left in the environment after they are used. In order to solve this problem, these products must be subjected to treatment such as incineration, recovery and recycling after being used. However, such treatment imposes considerable costs. Moreover, many used products cannot be recovered and are left in the environment, causing environmental disruption.

Among methods used to solve such a problem, there is a method utilizing a polymer material which is easily degraded by microorganisms present in the natural world. For example, surgical sutures comprising poly-ϵ-caprolactone and monofilaments comprising poly-β-propiolactone are disclosed in Japanese Patent Application Laid-Open (JP-A) Nos. H1-175855 and H5-78912 respectively. Poly-ϵ-caprolactone and poly-β-propiolactone, however, have melting temperatures as low as about 60° C. and about 97° C., respectively, giving rise to the problem that methods of using these compounds are limited.

Also, JP-A No. H5-93316 discloses a microorganism-degradable complex fiber using poly-ϵ-caprolactone and/or poly-β-propiolactone as the core component and poly(β-hydroxyalkanoate) or a copolymer thereof as the shell component. However, the melting temperatures of poly-ϵ-caprolactone and poly-β-propiolactone are about 60° C. and about 97° C. Therefore, in the case of using these compounds as fibers, deterioration of the strength of the fibers cannot be avoided when the operating temperature exceeds 100° C. or the temperature partly exceeds 100° C. by frictional heat.

As for an example of microorganism-degradable fibers having high melting temperature, surgical sutural materials comprising polylactic acid and a copolymer thereof are disclosed in JP-A No. S45-31696. However, such a fiber has insufficient strength and even though it can be made into a monofilament, the resulting monofilament is very hard so that it can be tied only with difficulty. Also its degradation is slow and cannot be controlled. As for polyglycolic acid type and polylactide type fibers, these fibers are commercially available as sutures. These fibers are, however, sensitive to moisture and tend to deteriorate. Also, these fibers are hard and this tends to limit their application. Moreover, they have a biological compatibility problem. For instance, when they are used as a suture for blood vessels, they can be said to be unsuitable because thrombi tend to be produced and adhesions of tissue are caused.

Biodegradable polyester fibers using random copolymer polyesters containing a 3-hydroxybutyric acid unit produced by microorganisms are disclosed in Biomaterials, 1987, Vol 8, 129. These so-called poly(3-hydroxybutyric acid) groups, i.e. homopolymers or copolymers containing less than 20% of other monomer units (hereinafter simply referred to as poly(3-hydroxybutyric acid)) are known to be degraded very well by bacteria which exist under the ground and in water in a large number. Also, they are used in applications, such as non-woven fabrics for preventing adhesions of tissue after surgical operations, because of their excellent biological compatibility. However, when they are made into fibers, the spinning and drawing of these fibers are found to be difficult, giving rise to the problem that high strength fibers cannot be obtained. For example, it is reported that after a poly(3-hydroxybutyric acid) produced by microorganisms are melted and extruded in a melt spinning step, they are deformed rubber-wise in a stage of drawing them into filaments when they are not crystallized whereas when they are highly crystallized, they are brittle-fractured at any temperature or even if any stress is applied, with the result that the spun filaments are brittle and hence have very low strength (Elsevier Applied Science, London, pp33–43, 1988).

SUMMARY OF THE INVENTION

As outlined above, a biodegradable fiber has not yet been obtained which has a high strength and melting temperature which are fit for practical use and which exhibits excellent biodegradability and hydrolyzability so that it can be widely utilized as, for example, agricultural materials, articles for everyday living and medical supplies.

Therefore, objects of the present invention are to provide a biodegradable complex fiber which maintains excellent biodegradability and hydrolyzability and has a high strength and melting temperature which are fit for practical use and to provide a method for producing the biodegradable complex fiber.

The inventors of the present invention have made earnest studies concerning each component material of a core-shell type fiber to solve the above problems. As a result, the inventors found that if a core component and a shell component are respectively formed of specific polymer materials, a complex fiber which has high strength, exhibits a melting temperature that can be freely controlled in a temperature range between 100° C. and 180° C., possesses expansion ability ("expandability") that can be controlled and has good biodegradability and hydrolyzability can be obtained by melt spinning. Thus, the present invention has been completed.

According to a first aspect of the present invention, there is provided a biodegradable complex fiber comprising at least one polymer selected from the group consisting of a polyglycolic acid, a poly(glycolic acid-co-lactic acid) and polylactic acid as a core component and a poly(3-hydroxybutyric acid) as a shell component.

According to a second aspect of the present invention, there is provided a biodegradable complex fiber comprising at least one polymer selected from the group consisting of a polyglycolic acid, a poly(glycolic acid-co-lactic acid) and polylactic acid as a core component and an aliphatic polyester consisting of a dibasic acid and a diol as a shell component.

According to a third aspect of the present invention, there is provided a biodegradable complex fiber comprising poly (3-hydroxybutyric acid) as a core component and at least one polymer selected from the group consisting of a polyglycolic acid, a poly(glycolic acid-co-lactic acid) and polylactic acid as a shell component.

According to a fourth aspect of the present invention, there is provided a biodegradable complex fiber comprising an aliphatic polyester consisting of a dibasic acid and a diol as a core component and at least one polymer selected from the group consisting of a polyglycolic acid, a poly(glycolic acid-co-lactic acid) and polylactic acid as a shell component.

According to a fifth aspect of the present invention which relates to the first and second aspects, there is provided a method for producing a biodegradable complex fiber comprising melt-spinning and drawing at least one polymer selected from the group consisting of a polyglycolic acid, a poly(glycolic acid-co-lactic acid) and polylactic acid as a core component and a poly(3-hydroxybutyric acid) or an aliphatic polyester consisting of a dibasic acid and a diol as a shell component by using a spinneret for complex fiber.

According to a sixth aspect of the present invention relating to the third and fourth aspects, there is provided a method for producing a biodegradable complex fiber comprising melt-spinning and drawing a poly(3-hydroxybutyric acid) or an aliphatic polyester consisting of a dibasic acid and a diol as a core component and at least one polymer selected from the group consisting of a polyglycolic acid, a poly(glycolic acid-co-lactic acid) and polylactic acid as a shell component at the same time by using a spinneret for complex fiber.

In one embodiment of the method according to the fifth or sixth aspect of the present invention, the drawing is performed at a temperature lower than the melting temperature of the polymer material at a drawing magnification or ratio of 5× to 10×.

In the present invention, a core-shell type biodegradable complex fiber is constituted using at least one polymer (hereinafter called a "material A") selected from the group consisting of a polyglycolic acid, a poly(glycolic acid-co-lactic acid) and polylactic acid and a poly(3-hydroxybutyric acid) or of an aliphatic polyester consisting of a dibasic acid and a diol (hereinafter called a "material B"), wherein either when the material A is the core component, the material B is the shell component, or when the material A is the shell component, the material B is the core component. By properly selecting materials constituting the core component and the shell component from the materials A and B and by appropriately selecting the ratio by volume of the core component to the shell component, a biodegradable complex fiber having higher strength than biodegradable complex fibers which are conventionally used and a melting temperature ranging from 100° C. to 180° C. can be obtained by melt spinning. Such a biodegradable complex fiber can also be controlled with respect to its expandability and produces excellent biodegradable and hydrolyzable effects. Such effects cannot be obtained only by blending and spinning the materials A and B.

DETAILED DESCRIPTION OF THE INVENTION

Figure 1A:
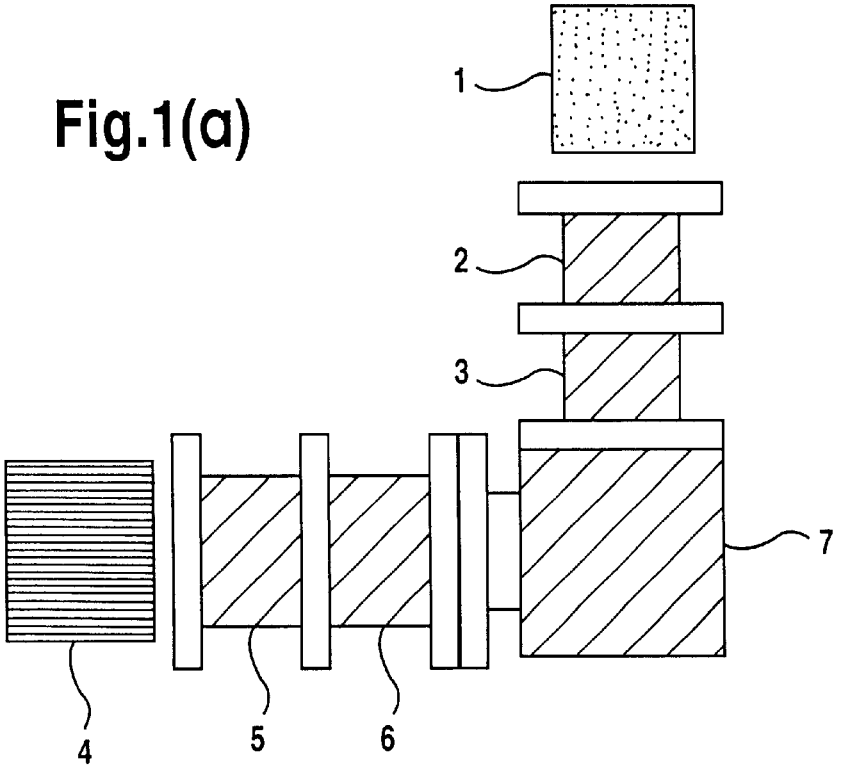
FIG. 1 is a view showing a melt spinning machine used in the examples.

The present invention will be explained in detail. Firstly, a polymer (a biodegradable polyester) used in the present invention will be explained.

Preferable examples of the poly(3-hydroxybutyric acid) used in the biodegradable complex fiber of the present invention may include a poly(3-hydroxybutyric acid) (hereinafter, (R)-isomers and (S)-isomers are abbreviated as P[(R)-3HB] and P[(S)-3HB] respectively) and copolymerized polyesters of 3-hydroxybutyric acid such as a poly(3-hydroxybutyric acid-co-3-hydroxypropanoic acid), poly(3-hydroxybutyric acid-co-3-hydroxypentanoic acid), poly(3-hydroxybutyric acid-co-4-hydroxybutyric acid), poly(3-hydroxybutyric acid-co-3-hydroxyhexanoic acid), poly(3-hydroxybutyric acid-co-3-hydroxyheptanoic acid), poly(3-hydroxybutyric acid-co-3-hydroxyoctanoic acid), poly(3-hydroxybutyric acid-co-5-hydroxypentanoic acid), poly(3-hydroxybutyric acid-co-3-methyl-5-hydroxypentanoic acid), poly(3-hydroxybutyric acid-co-6-hydroxyhexanoic acid), poly(3-hydroxybutyric acid-co-15-hydroxypentadecanoic acid), poly(3-hydroxybutyric acid-co-L-lactide), poly(3-hydroxybutyric acid-co-7-methyl-1,4-dioxepan-5-one) and poly(3-hydroxybutyric acid-co-12-oxa-16-hexadecanoride). The amount of the monomer copolymerized with 3-hydroxybutyric acid is less than 20%. Among these compounds, P[(R)-3HB] and P[(S)-3HB] are preferable.

The poly(3-hydroxybutyric acid) preferably has a weight average molecular weight ($M_w$) of about 300,000 to 2,000,000 and a melting temperature ($T_m$) of about 100–180° C. As the poly (3-hydroxybutyric acid) any one of chemical synthetic products and products synthesized by microorganisms may be used. In the case of synthetic poly(3-hydroxybutyric acid), the optical purity of monomer, i.e., β-butyrolactone, is preferably 90% ee or more although it is limited as long as the fiber strength is not reduced.

Examples of aliphatic polyesters consisting of a dibasic acid and a diol which are likewise used in the biodegradable complex fiber of the present invention may include polyethylene oxalate, polyethylene malonate, polyethylene succinate, polypropylene oxalate, polypropylene malonate, polypropylene succinate, polybutylene oxalate, polybutylene malonate, polybutylene succinate, polyethylenedecane dioate and polyethylenetridecane dioate and copolymers of these compounds and a diisocyanate or a lactide. When diisocyanates and lactides are added to an aliphatic polyester, they react with hydroxy groups at the end of the polymer and increase the molecular weight of and stabilize the polymer. Among these compounds, a polybutylene succinate, a copolymer of a polybutylene succinate and a diisocyanate and a copolymer of a polybutylene succinate and a lactide are preferable.

The polyglycolic acid useful in the invention preferably has a $M_w$ of about 50,000 to 200,000 and a $T_m$ of about 237° C.

The polylactic acid useful in the present invention preferably has a $M_w$ of 50,000 to 200,000 and a $T_m$ of about 178° C.

The poly(glycolic acid-co-lactic acid), i.e., copolymer of glycolic acid and lactic acid, useful in the present invention preferably has a $M_w$ of about 50,000 to 200,000 and a $T_m$ of about 160–165° C.

The aliphatic polyester useful in the present invention preferably has a $M_w$ of about 50,000 to 200,000 and a $T_m$ of about 110° C.

In the biodegradable complex fiber of the present invention, preferably the core portion is constituted of a polyglycolic acid (hereinafter abbreviated as "PGA") which is sensitive to moisture though it has a high melting temperature or of polylactic acid (hereinafter abbreviated as "PLA") and the shell portion is constituted of a compound having excellent biological compatibility such as a poly(3-hydroxybutyric acid) or an aliphatic polyester consisting of a dibasic acid and a diol.

Although the biodegradable polymer material (biodegradable polyester) used in the present invention can be obtained by a well-known production method, a commercially available product may be used as the biodegradable polymer material. As required, two or more types may be combined.

In the present invention, the ratio by volume of the core portion to the shell portion of the biodegradable complex fiber is 10:90 to 90:10. Such a ratio by volume may be arbitrarily changed by changing the rotating speed of a motor, the diameter of a nozzle and the diameter of a cylinder in a melt spinning machine corresponding to the qualities of the polymer material to be used.

When the biodegradable complex fiber of the present invention is produced by melt spinning, a spinneret for complex fiber which has a diameter of about 1.0 mm, and, as required, larger than 1.0 mm, is used. The temperature of the spinneret portion depends upon the degree of polymerization and composition of the polymer material, is 100 to 240° C. and, preferably, 200 to 240° C. The temperature of the melting portion is generally above the melting temperature of the polymer material to be used. However, if the temperature exceeds 240° C., the polymer is degraded significantly, making it difficult to obtain high strength fibers.

Usual compounding ingredients such as stabilizers and colorants may be appropriately added to the biodegradable polymer material of the present invention. In order to increase recrystallization rate and to improve processability, core agents such as talc, boron nitride, titanium oxide, micromica and chalk may be added as required in an amount of 0.01 to 1% by weight.

The fiber which has been melt-spun is continuously drawn either after it is once rolled or without being rolled. The drawing is carried out at room temperature, or using hot air or a heated plate or a hot pin, or in a heating medium such as water, glycerol, ethylene glycol or silicone oil at 30 to 150° C. and, preferably, 50 to 120° C. It is generally desirable to carry out such drawing at a temperature lower than the melting temperature of the aforementioned biodegradable polymer material at a drawing magnification of 5× to 10× corresponding to the desired requirements. A magnification less than 5× brings about a small increase in the strength whereas a magnification exceeding 10× results in frequent occurrences of breaking.

The fiber drawn in this manner is heat-treated as required at 50 to 150° C. The fineness of the finally obtained fiber of the present invention is usually 50 d or more although it differs depending upon its application.

EXAMPLES

The present invention will be hereinafter explained in more detail by way of examples, test examples and the like, which are not intended to limit the present invention.

Instruments for analysis used in the examples and test examples are as follows.

1) Melt spinning machine: 15 θ miniature spinning machine (manufactured by Ooba Machine Corporation).

2) Drawing machine: Miniature thermal drawing machine (equipped with a bath) (manufactured by Ooba Machine Corporation).

3) Strength measuring instrument: Shimadzu AGS500B (manufactured by Shimadzu Corporation).

The data of the drawing magnification, drawing temperature, tensile strength, elastic modulus, elongation at break, outside diameter and core diameter are collectively shown in the following Table 1.

Example 1

(Production of P[(R)-3HB] (Shell)-PGA (Core) Complex Fiber)

Figure 1B:
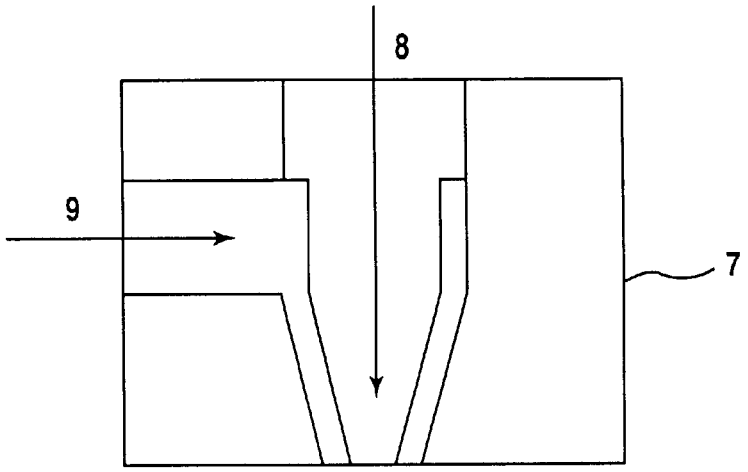
Figure 2:
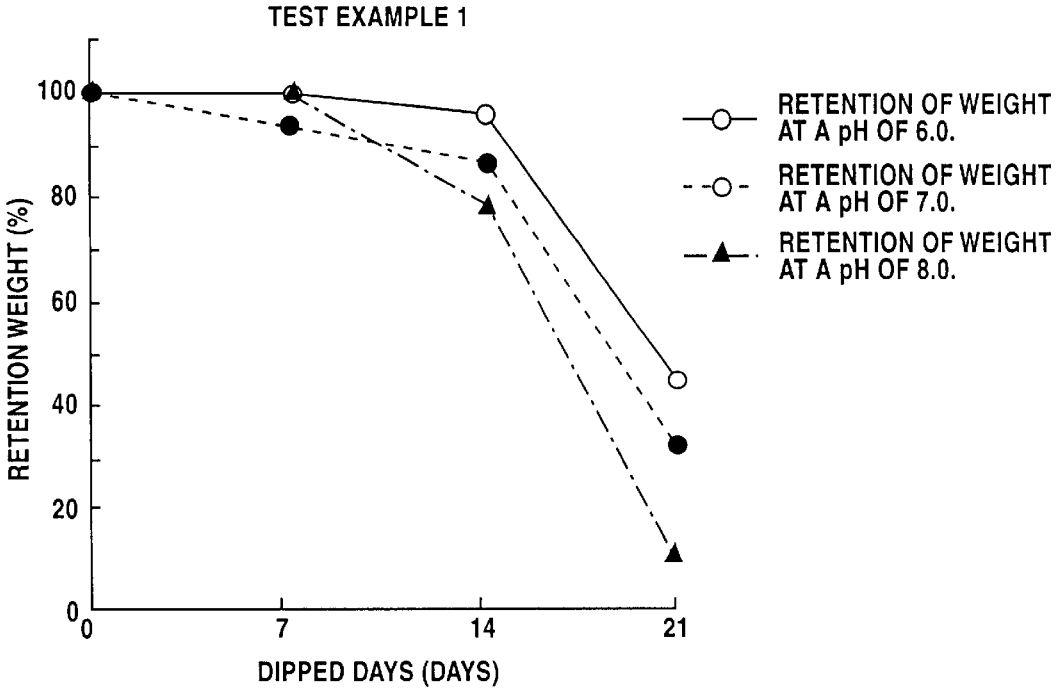
FIG. 2 is a graph showing the relation between days elapsed and retention of weight in a test example 1 of a degradability test.
Figure 3:
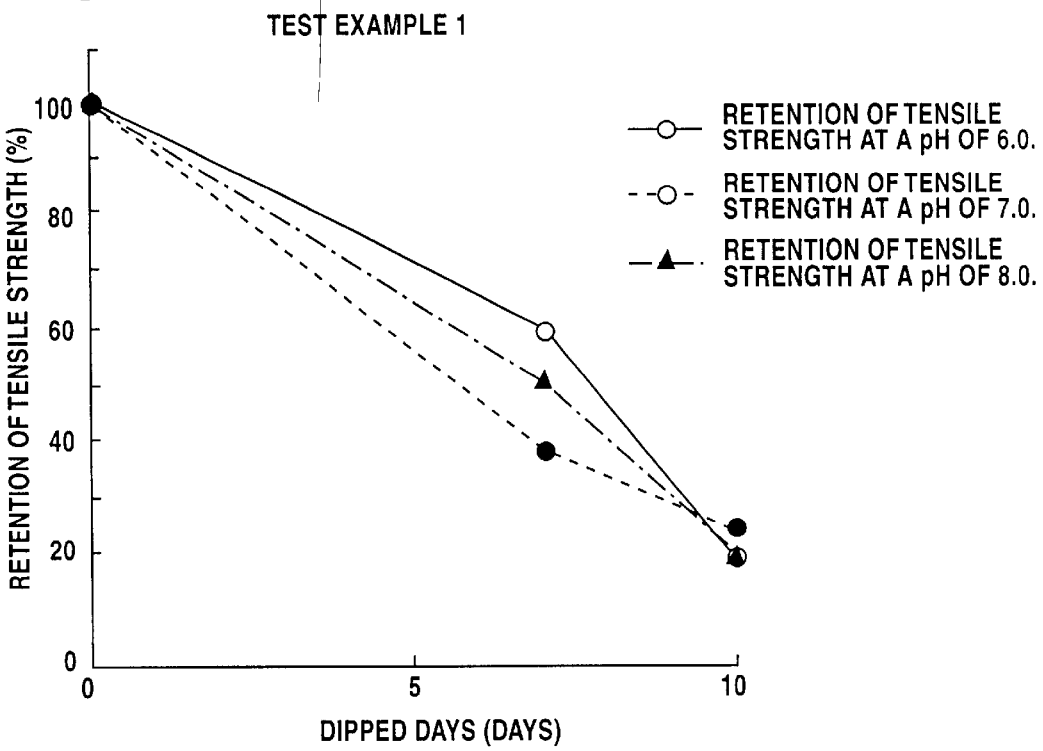
FIG. 3 is a graph showing days elapsed and retention of tensile strength in the test example 1 of the degradability test.

Using the melt spinning machine shown in FIG. 1, PGA (weight average molecular weight: 100,000, melting temperature: 237° C., glass transition temperature: 37° C.) was supplied from core polymer material inlet 8 under conditions that the temperature of cylinder 2 was 200° C., the temperature of cylinder 3 was 225° C. and the temperature of nozzle 7 was 232° C. and P[(R)-3HB] (chemical synthetic product, weight average molecular weight: 315,000, optical purity of a monomer: 94% ee, melting temperature: 168° C., glass transition temperature: 0° C.) was supplied from shell polymer material inlet 9 under conditions that the temperature of cylinder 5 was 140° C., the temperature of cylinder 6 was 155° C. and the temperature of nozzle 7 was 232° C. Both PGA and P[(R)-3HB] were melt-extruded at the same time and the resulting fiber was drawn at 63° C. at a magnification of 6×. The ratio by volume of the polymer materials in the resulting fiber was as follows: P[(R)-3HB]:PGA=40:60. This fiber had two melting temperatures; 157.7° C. (P[(R)-3HB]) and 216.4° C. (PGA).

Figure 4:
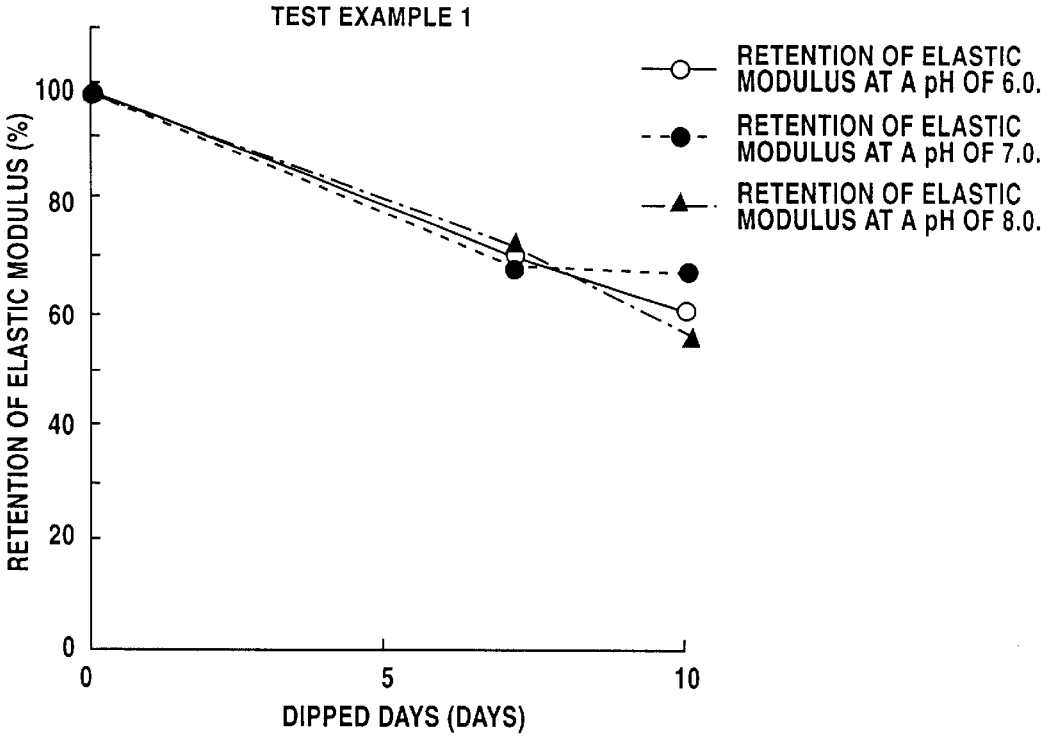
FIG. 4 is a graph showing the relation between days elapsed and retention of elastic modulus in the test example 1 of the degradability test.
Figure 5:
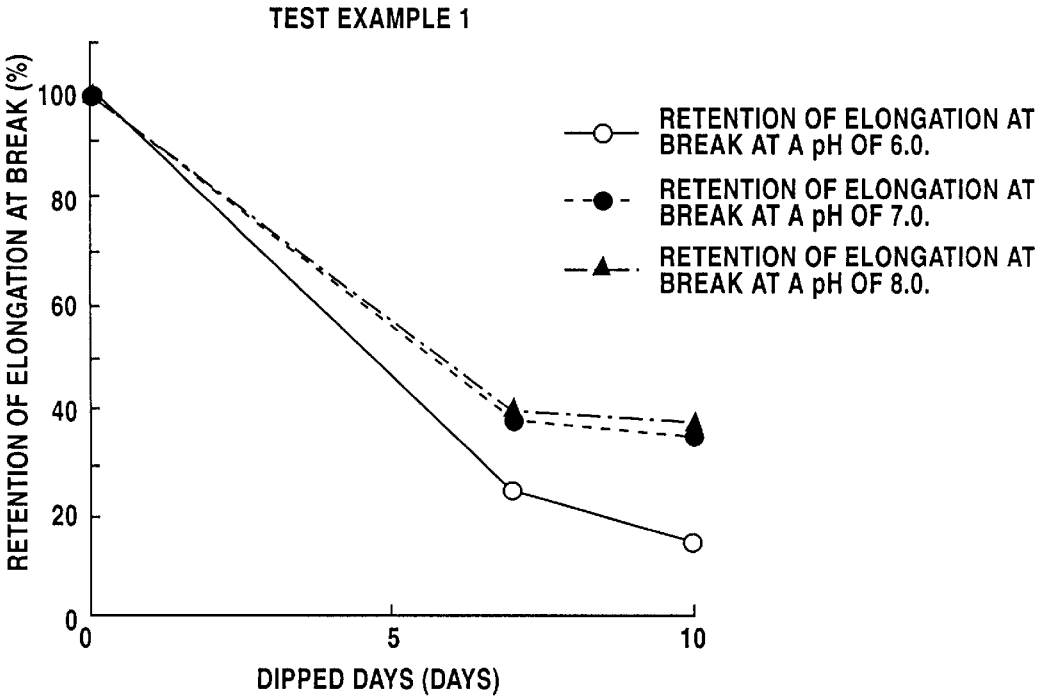
FIG. 5 is a graph showing the relation between days elapsed and retention of elongation at break in the test example 1 of the degradability test.
Figure 6:
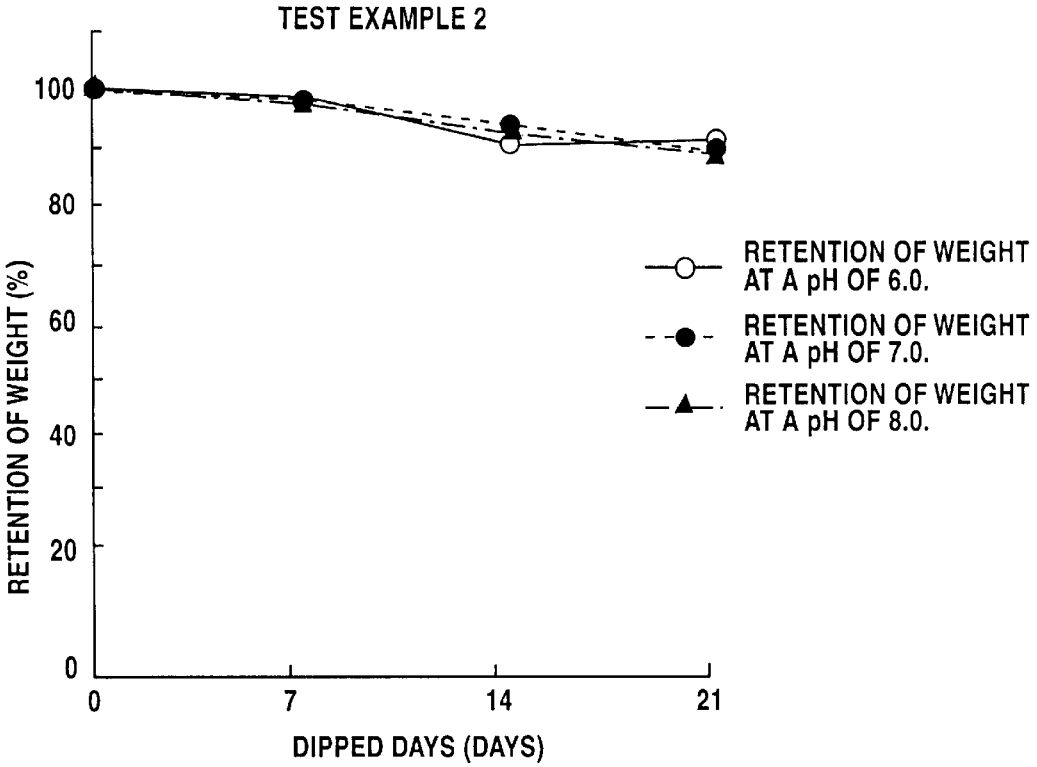
FIG. 6 is a graph showing the relation between days elapsed and retention of weight in a test example 2 of the degradability test.
Figure 7:
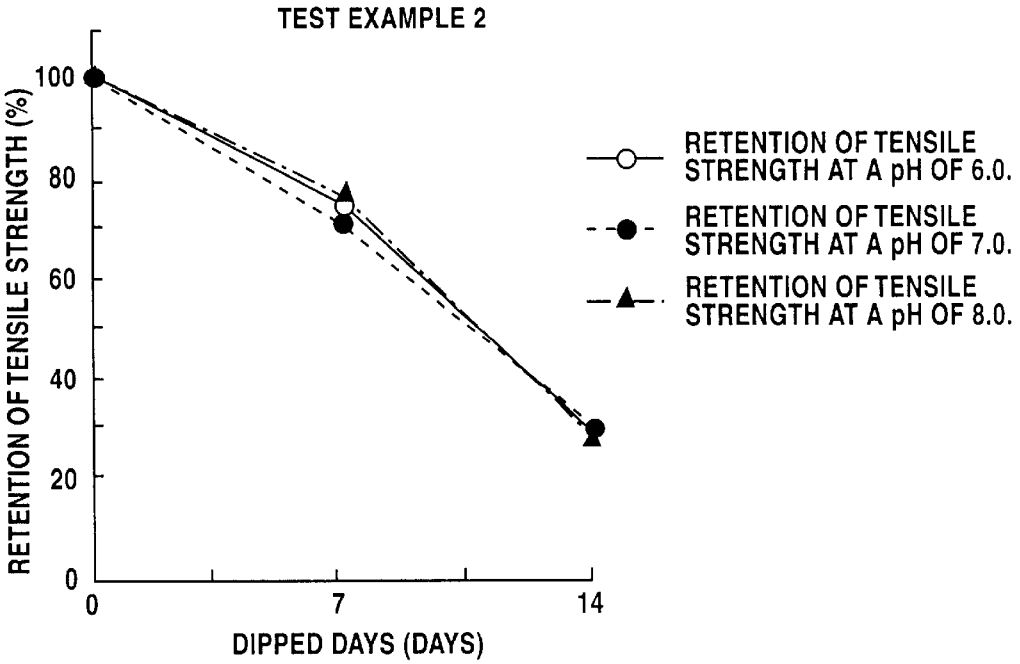
FIG. 7 is a graph showing the relation between days elapsed and retention of tensile strength in the test example 2 of the degradability test.
Figure 8:
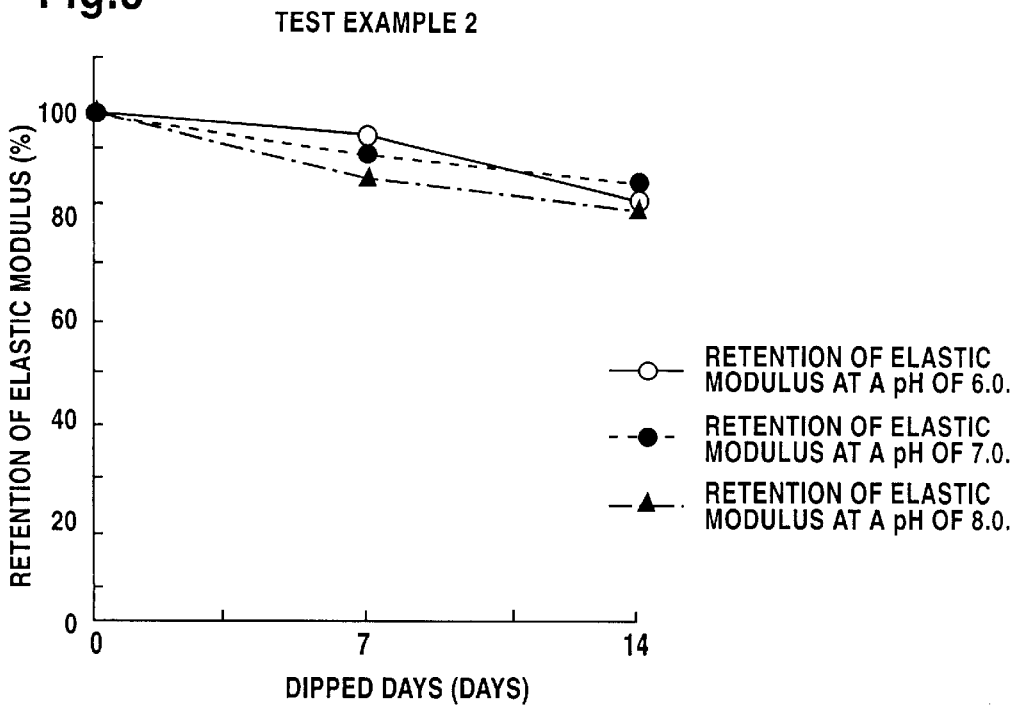
FIG. 8 is a graph showing the relation between days elapsed and retention of elastic modulus in the test example 2 of the degradability test.
Figure 9:
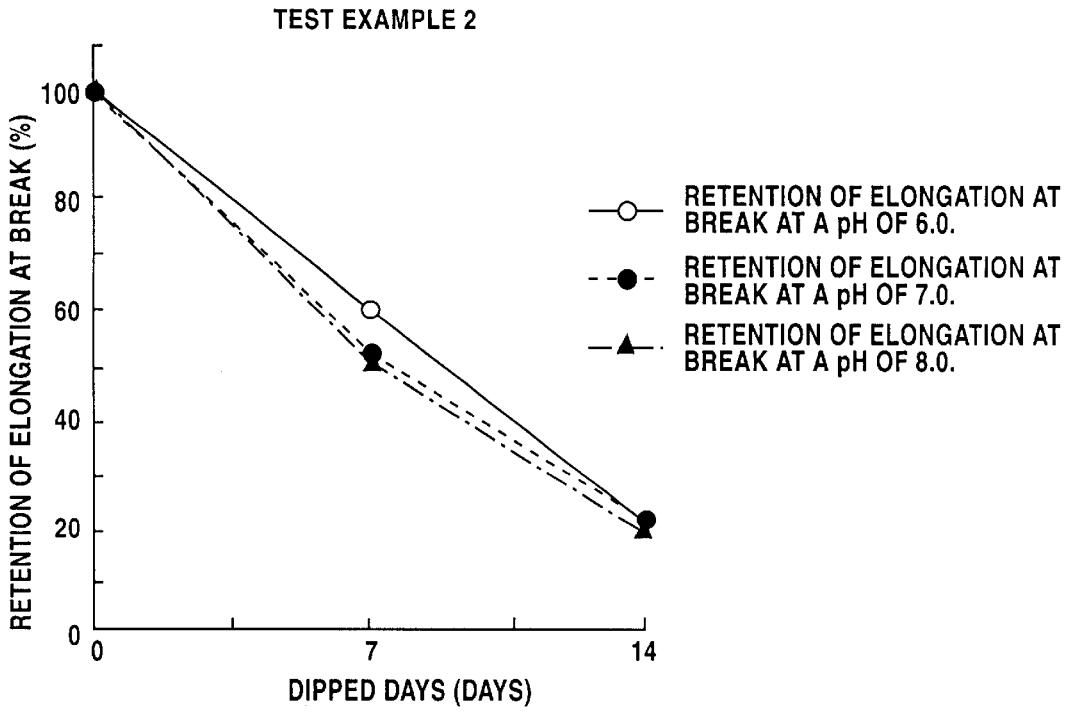
FIG. 9 is a graph showing the relation between days elapsed and retention of elongation at break in the test example 2 of the degradability test.

In a melt spinning machine shown in (A) of FIG. 1, 1 and 4 respectively show a motor and (B) in FIG. 1 shows the state of the inside of the nozzle 7.

Example 2

(Production of P[(R)-3HB] (Shell)-PGA (Core) Complex Fiber)

A complex fiber was produced in the same manner as in Example 1 except that the fiber obtained by melt extrusion was drawn at 67° C. at a magnification of 7×. The ratio by volume of the polymer materials in the resulting fiber was as follows: P[(R)-3HB]:PGA=42:58.

Example 3

(Production of P[(R)-3HB] (Shell)-PGA (Core) Complex Fiber)

Using a melt spinning machine shown in FIG. 1 and the same PGA and P[(R)-3HB] that were used in Example 1, PGA was supplied from the core polymer material inlet 8 under conditions that the temperature of the cylinder 2 was 200° C., the temperature of the cylinder 3 was 240° C. and the temperature of the nozzle 7 was 240° C. and P[(R)-3HB] was supplied from the shell polymer material inlet 9 under conditions that the temperature of the cylinder 5 was 140° C., the temperature of the cylinder 6 was 230° C. and the temperature of the nozzle 7 was 240° C. Both PGA and P[(R)-3HB] were melt-extruded at the same time and the resulting fiber was drawn at 80° C. at a magnification of 9×. The ratio by volume of the polymer materials in the resulting fiber was as follows: P[(R)-3HB]:PGA=36:64.

Example 4

(Production of P[(R)-3HB] (Shell)-PGA (Core) Complex Fiber)

A complex fiber was produced in the same manner as in Example 3 except that the fiber obtained by melt extrusion was drawn at 50° C. at a magnification of 6×. The ratio by volume of the polymer materials in the resulting fiber was as follows: P[(R)- 3HB]:PGA=40:60.

Example 5

(Production of P[(R)-3HB] (Shell)-PGA (Core) Complex Fiber)

A complex fiber was produced in the same manner as in Example 3 except that the fiber obtained by melt extrusion was drawn at 5° C. at a magnification of 9×. The ratio by volume of the polymer materials in the resulting fiber was as follows: P[(R)-3HB]:PGA=57:43.

Example 6

(Production of Polybutylene Succinate-lactide Copolymer (Shell)-PGA (Core) Complex Fiber)

Using the melt spinning machine shown in FIG. 1, PGA (weight average molecular weight: 100,000, melting temperature: 237° C., glass transition temperature: 37° C.) was supplied from the core polymer material inlet 8 under conditionβüthat the temperature of the cylinder 2 was 200° C., the temperature of the cylinder 3 was 225° C. and the temperature of the nozzle 7 was 240° C. and a polybutylene succinate-lactide copolymer (hereinafter abbreviated as PBSL) (weight average molecular weight: 100,000, melting temperature: 110° C., glass transition temperature: −34° C.) was supplied from the shell polymer material inlet 9 under conditions that the temperature of the cylinder 5 was 200° C., the temperature of the cylinder 6 was 225° C. and the temperature of the nozzle 7 was 235° C. Both PGA and PBSL were melt-extruded at the same time and the resulting fiber was drawn at 80° C. at a magnification of 4×. The ratio by volume of the polymer materials in the resulting fiber was as follows: PBSL:PGA=44:56. This fiber had two melting temperatures; 105.2° C. (PBSL) and 214.9° C. (PGA).

Example 7

(Production of PBSL (Shell)-PGA (Core) Complex Fiber)

A complex fiber was produced in the same manner as in Example 6 except that the fiber obtained by melt extrusion was drawn at 80° C. at a magnification of 5×. The ratio by volume of the polymer materials in the resulting fiber was as follows: PBSL:PGA=44:56.

Example 8

(Production of P[(R)-3HB] (Shell)-poly-L-lactic Acid) (Core) Complex Fiber)

Using the melt spinning machine shown in FIG. 1 and a poly-L-lactic acid (hereinafter abbreviated as PLLA) (weight average molecular weight: 200,000, melting temperature: 178° C., glass transition temperature: 61° C.) and the same P[(R)-3HB] that was used in Example 1, PLLA was supplied from the core polymer material inlet 8 under conditions that the temperature of the cylinder 2 was 200° C., the temperature of the cylinder 3 was 200° C. and the temperature of the nozzle 7 was 210° C. and P[(R)-3HB] was supplied from the shell polymer material inlet 9 under conditions that the temperature of the cylinder 5 was 160° C., the temperature of the cylinder 6 was 168° C. and the temperature of the nozzle 7 was 210° C. Both PLLA and P[(R)-3HB] were melt-extruded at the same time and the resulting fiber was drawn at 80° C. at a magnification of 5×. The ratio by volume of the polymer materials in the resulting fiber was as follows: P[(R)-3HB]:PLLA=93:7.

Example 9

(Production of P[(R) -3HB] (Shell)-PGA (Core) Complex Fiber)

A complex fiber was produced in the same manner as in Example 3 except that the discharge amount from the shell polymer material inlet 9 was altered to one-half that of Example 3 and the fiber obtained by melt extrusion was drawn at a magnification of 7×. The ratio by volume of the polymer materials in the resulting fiber was as follows: P[(R)-3HB]:PGA=18:82.

TABLE 1

| | Shell component | Core component | Ratio by volume (shell:core) | Drawing magnification (magnifications) | Drawing temperature (° C.) | Tensile strength (MPa) | Elastic modulus (GPa) | Elongation at break (%) | Outside diameter (μ) | Core diameter (μ) |
|---|---|---|---|---|---|---|---|---|---|---|
| Example 1 | P[(R)-3HB] | PGA | 40:60 | 6.0 | 50 | 536 | 4.23 | 182 | 59 | 46 |
| Example 2 | P[(R)-3HB] | PGA | 42:58 | 6.0 | 50 | 403 | 3.73 | 176 | 79 | 52 |
| Example 3 | P[(R)-3HB] | PGA | 36:64 | 6.0 | 63 | 700 | 9.2 | 88 | 40 | 31 |
| Example 4 | P[(R)-3HB] | PGA | 40:60 | 7.0 | 67 | 900 | 9.8 | 79 | 29 | 22 |

TABLE 1-continued

| | Shell component | Core component | Ratio by volume (shell:core) | Drawing magnification (magnifications) | Drawing temperature (° C.) | Tensile strength (MPa) | Elastic modulus (GPa) | Elongation at break (%) | Outside diameter (μ) | Core diameter (μ) |
|---|---|---|---|---|---|---|---|---|---|---|
| Example 5 | P[(R)-3HB] | PGA | 57:43 | 9.0 | 80 | 1000 | 11 | 68 | 25 | 20 |
| Example 6 | PBSL | PGA | 44:56 | 4.0 | 80 | 630 | 6.2 | 100 | 76 | 57 |
| Example 7 | PBSL | PGA | 44:56 | 5.0 | 80 | 800 | 7.5 | 77 | 68 | 51 |
| Example 8 | P[(R)-3HB] | PLLA | 93:7 | 5.0 | 80 | 380 | 3.9 | 250 | 200 | 54 |
| Example 9 | P[(R)-3HB] | PGA | 18:82 | 7.0 | 63 | 880 | 14.7 | 125 | 44 | 40 |

Degradability tests

The degradability test of the complex fibers was made as follows.

15 filaments (about 80 mm per filament) of the complex fiber were tied up in a bundle to be weighed and were sterilized by UV-rays for 30 minutes to make a sample. While vials for phosphoric acid buffer solutions of pHs of 6.0, 7.0 and 8.0 were respectively sterilized under pressure at 121° C. for 20 minutes. The above sample was filled in these vials and dipped in the phosphoric acid buffer solution of each pH to carry out a degradability test at 37° C.

Test Example 1

(Degradability Test for P[(R)-3HB] (Shell)-PGA (Core) Complex Fiber)

The complex fiber with the following ratio by volume: P[(R)-3HB]:PGA=18:82, which was obtained in Example 9 was measured for the retention of weight 2 weeks and 3 weeks after the test was started, the retention of tensile strength 7 days and 10 days after the test was started, the retention of elastic modulus 7 days and 10 days after the test was started and the retention of elongation at break 7 days and 10 days after the test was started in each of phosphoric acid buffer solutions of pHs of 6.0, 7.0 and 8.0. The obtained results are shown in FIG. 2, FIG. 3, FIG. 4 and FIG. 5, respectively.

From these results, each retention of weight is 48%, 35% and 12% three weeks after, showing that the sample is considerably degraded. The retention of tensile strength of every one of the samples is around 23% 10 days after, showing that the strength is extremely reduced. The retention of elastic modulus of every one of the samples is around 63% 10 days after, showing that the elastic modulus is remarkably reduced. Moreover, each retention of elongation at break is 16%, 36% and 38% 10 days after, showing that it is considerably decreased in every case and the sample was made brittle. It is found from these results that the degradability of the complex fiber is good.

Test Example 2

(Degradability Test for PBSL (Shell)-PGA (Core) Complex Fiber)

The complex fiber with the following ratio by volume: PBSL:PGA=44:56, which was obtained in Example 6 was measured for the retention of weight 1 week, 2 weeks and 3 weeks after the test was started, the retention of tensile strength 1 week and two weeks after the test was started, the retention of elastic modulus 1 week and 2 weeks after the test was started and the retention of elongation at break 1 week and two weeks after the test was started in each of phosphoric acid buffer solutions of pHs of 6.0, 7.0 and 8.0. The obtained results are shown in FIG. 6, FIG. 7, FIG. 8 and FIG. 9, respectively.

From these results, the retention of weight of every sample is 92%, showing that the sample is degraded. The retention of tensile strength of every one of the samples is around 30% two weeks after, showing that the strength is extremely reduced. The retention of elastic modulus of every one of the samples is around 85% two weeks after, showing that the elastic modulus is reduced. Moreover, the retention of elongation at break of every sample is around 20% two weeks after, showing that it is considerably decreased and the sample was made brittle. It is found from these results that the degradability of the complex fiber is good.

Comparative Test Example 1

(Degradability Test for PLLA Mono Filament)

Figure 10:
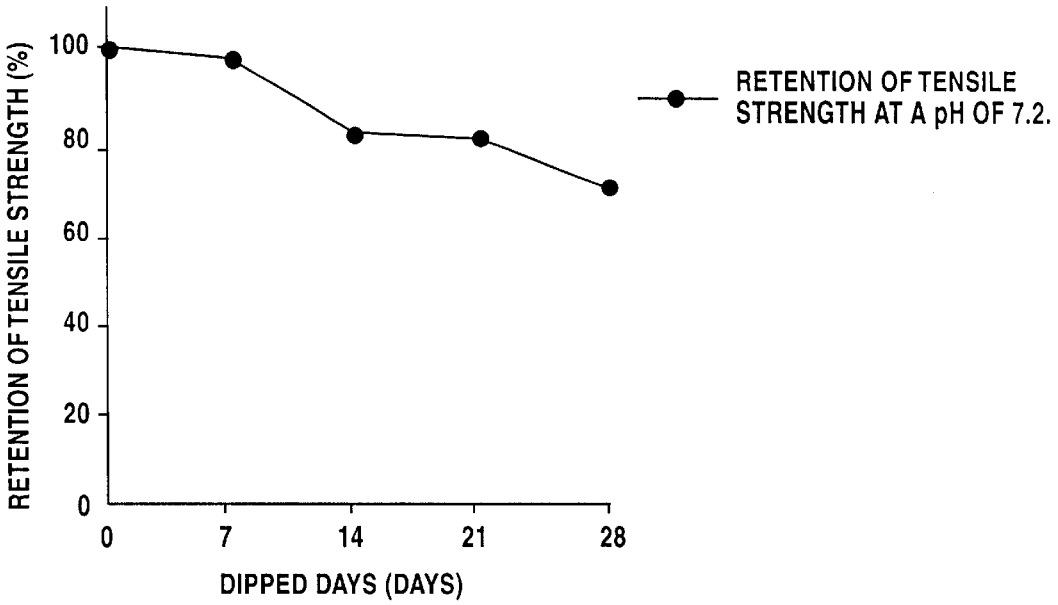
FIG. 10 is a graph showing the relation between days elapsed and retention of tensile strength in a comparative test example 1 of the degradability test.

A PLLA mono filament was measured for the retention of tensile strength 1 week, 2 weeks, 3 weeks and 4 weeks after the test was started in a phosphoric acid buffer solution of a pH of 7.2. The obtained results are shown in FIG. 10. Comparing the results shown in FIG. 10 with the results shown in FIG. 3 (P[(R)-3HB] (shell)-PGA (core) complex fiber) and with the results shown in FIG. 7 (PBSL (shell)-PGA (core) complex fiber), it is found that a reduction in the strength of the PLLA mono filament is slow, showing that the PLLA mono filament is degraded slowly.

Comparative Test Example 2

(Degradability Test for PGA Mono Filament)

Figure 11:
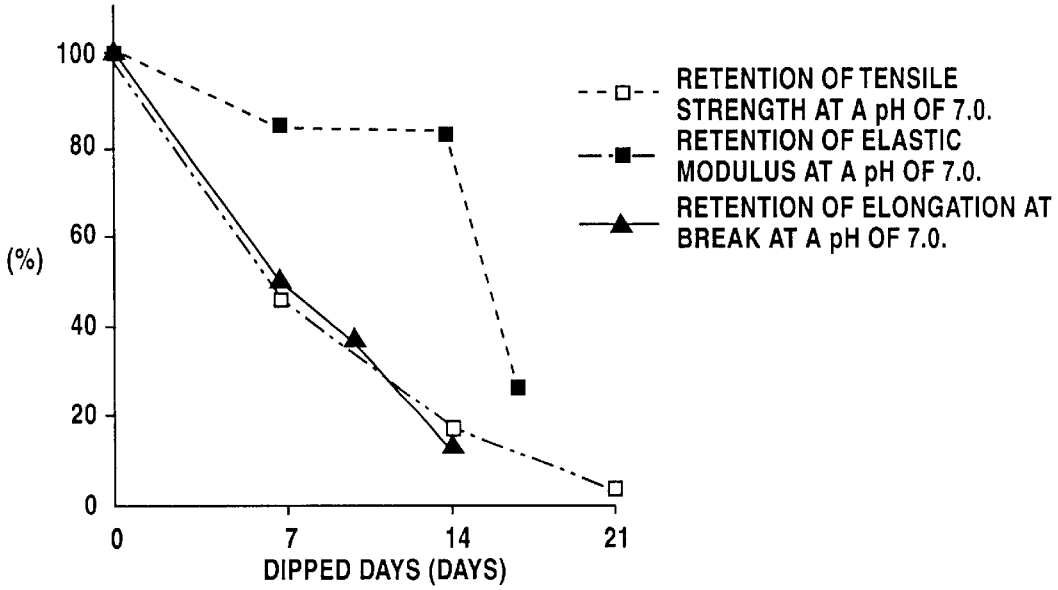
FIG. 11 is a graph showing the relation between days elapsed and retention of tensile strength or retention of elastic modulus or retention of elongation at break in a comparative test example 2 of the degradability test.

A PGA mono filament was measured for the retention of tensile strength 1 week, 2 weeks and 3 weeks after the test was started, the retention of elastic modulus 1 week, 2 weeks and 17 days after the test was started and the retention of elongation at break 1 week and 2 weeks after the test was started, in a phosphoric acid buffer solution of a pH of 7.0. The obtained results are shown in FIG. 11. It is understood from the results shown in FIG. 11 that a reduction in the tensile strength is the same as or slightly slower than that shown in FIG. 3 (P[(R)-3HB] (shell)-PGA (core) complex fiber) but faster than that shown in FIG. 7 (PBSL (shell)-PGA (core) complex fiber). The retention of elastic modulus is kept higher than that shown in FIG. 4 (P[(R)-3HB] (shell)-PGA (core) complex fiber) and is the same as that of the results shown in FIG. 8 (PBSL (shell)-PGA (core) complex fiber) until 2nd weeks. Moreover, the retention of elongation at break is lost quickly and specifically, it is decreased more quickly than that shown in FIG. 5 (P[(R)-3HB] (shell)-PGA (core) complex fiber) and that shown in FIG. 9 (PBSL (shell)-PGA (core) complex fiber). Namely, the PGA single fiber quickly becomes easily cut.

Comparative Test Example 3
(Degradability Test for PBSL Mono Filament)

Figure 12:
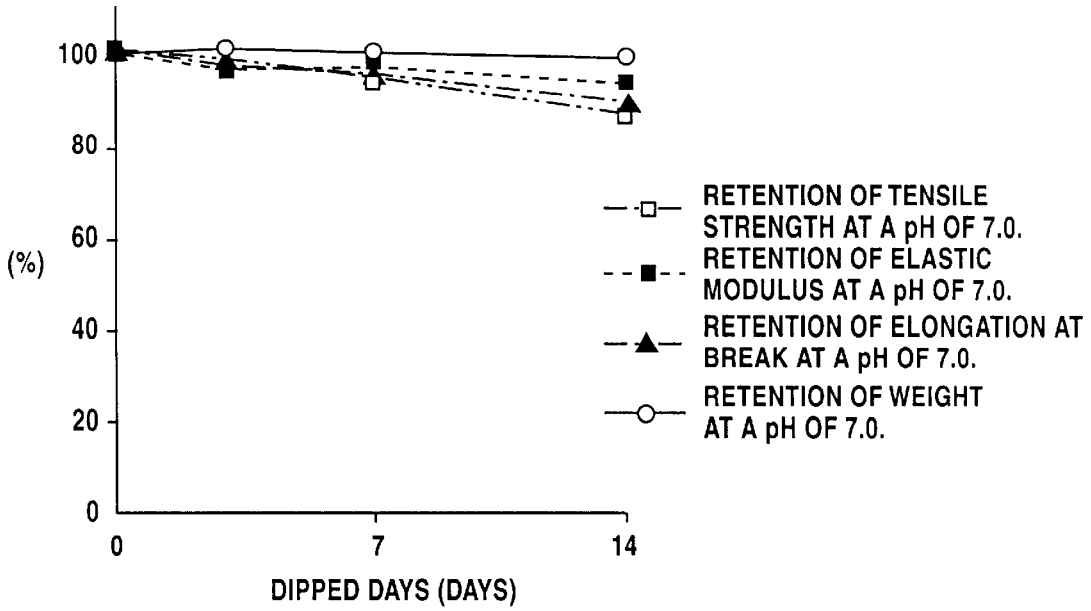
FIG. 12 is a graph showing the relation between days elapsed and retention of tensile strength or retention of elastic modulus or retention of elongation at break in a comparative test example 3 of the degradability test.

A PBSL mono filament was measured for the retention of tensile strength, retention of elastic modulus, retention of elongation at break and retention of weight 1 week and 2 weeks after the test was started, in a phosphoric acid buffer solution of a pH of 7.0. The obtained results are shown in FIG. 12. It is found from the results shown in FIG. 12 that each reduction in the retention of weight, retention of tensile strength, retention of elastic modulus and retention of elongation at break is extremely slow.

As is clear from the results of Comparative test examples 1–3, the PLLA mono filament is degraded slowly and it is difficult to control the degradation rate because it is a mono filament. The PGA mono filament, though its degradation is fast, the control of degradation rate is difficult because it is a mono filament. The PBSL is degraded very slowly. On the contrary, the degradation rate of the complex fiber of the present invention can be controlled with ease by properly selecting the ratio of the shell component to the core component and the qualities of these shell and core components.

As explained above, in the core-shell type biodegradable complex fiber of the present invention, even if the polymer material (biodegradable polyester) to be used has the drawbacks of low extension, high brittleness, impaired hydrolyzability, excessively high hydrolyzability, reduced biodegradability and impaired biological compatibility, these drawbacks can be overcome by using, as either one of the core component and the shell component, a polymer material (biodegradable polyester) having high extension, low brittleness, appropriate hydrolyzability, high biodegradability and good biological compatibility. Also, by these measures, the expandability can be controlled and hence a biodegradable complex fiber with high strength can be produced. As a consequence, the biodegradable complex fiber of the present invention is a polyester complex fiber which has heat resistance sufficient for use in usual material applications, has melting temperatures and degradation rates that can be optionally changed for use in medical applications and has high strength and biodegradability.

Accordingly, the biodegradable complex fiber is preferable as fishing materials, e.g., fishing lines and fish nets; agricultural materials, e.g., insect or bird nets and vegetation nets; cloth fibers and non-woven fibers for articles for everyday life, e.g., disposable women's sanitary items, masks, wet tissues, underwear, towels, handkerchiefs, kitchen towels and diapers; and other general industrial materials. They are degraded and reduced in strength by leaving them in the environment, under which microorganisms can exist, after they are used and can be completely degraded after a fixed period of time. Therefore, if the fiber of the present invention is used, it is possible to prevent environmental pollution and environmental disruption without the provision of special waste treating equipment. Furthermore, the fiber of the present invention has biological compatibility and excellent stability in human tissue so that it is hydrolyzed and absorbed in the body. Therefore the fiber of the present invention can be utilized as medical supplies, e.g., operating sutures which need not be removed, operating nets and suture-reinforcing materials.

What is claimed is:

1. A biodegradable complex fiber comprising at least one polymer selected from the group consisting of a polyglycolic acid, a poly(glycolic acid-co-lactic acid) and polylactic acid as a core component and a poly(3-hydroxybutyric acid) as a shell component.

2. A method for producing a biodegradable complex fiber according to claim 1, comprising melt-spinning and drawing at least one polymer selected from the group consisting of a polyglycolic acid, a poly(glycolic acid-co-lactic acid) and polylactic acid as a core component and a poly(3-hydroxybutyric acid) as a shell component using a spinneret for complex fiber.

3. A method for producing a biodegradable complex fiber according to claim 2, wherein said drawing is performed at a temperature lower than the melting temperature of the core component and shell component at a drawing magnification of 5× to 10×.

* * * * *